US006142005A

United States Patent [19]

Tseng

[11] Patent Number: 6,142,005

[45] Date of Patent: Nov. 7, 2000

[54] DIE-PROTECTING DEVICE USED IN BENDING AN EMBOSSED METALLIC STRAIGHT PIPE WITH A SMALL DIAMETER AND A THIN WALL

[76] Inventor: Shao-Chien Tseng, No. 130 Sec. 2, Yang-Shin Rd., Yang-Mei Taoyuan 26, Taiwan

[21] Appl. No.: 09/330,361

[22] Filed: Jun. 11, 1999

[51] Int. Cl.[7] ..... B21D 9/01

[52] U.S. Cl. ..... 72/466; 72/369

[58] Field of Search ..... 29/423; 72/369, 72/466, 466.2

[56] References Cited

U.S. PATENT DOCUMENTS 2,989,109 6/1961 Heimberger ..... 72/369

5,272,905 12/1993 Parlow et al. ..... 72/466

*Primary Examiner*—Lowell A. Larson

*Attorney, Agent, or Firm*—Pro-Techtor International Services

[57] ABSTRACT

A die-protecting device used in bending an embossed metallic straight pipe with a small diameter and a thin wall is disclosed. Whereof a die core is placed in the straight embossed pipe to support and help the wall of the embossed pipe to bear bending force being scattered thereby and almost equally distributed to the whole wall and to get desired bending curvature. A pair of half-dies are put on and envelop the external wall surface of the embossed pipe to protect the embossed pipe. A flexible plastic pipe is slipped over the half-dies to protect the half-dies from loosening. A spiral spring is slipped over the plastic pipe, and a tension spring is slipped over the spiral spring. So that the bending force exerted on the half-dies, the embossed pipe and the plastic pipe can be more uniformly distributed, and the embossed pipe can be bent to et desired curvature.

3 Claims, 4 Drawing Sheets

DIE-PROTECTING DEVICE USED IN BENDING AN EMBOSSED METALLIC STRAIGHT PIPE WITH A SMALL DIAMETER AND A THIN WALL

BACKGROUND OF THE INVENTION

1. Field of the Invention

The present invention is related to a die-protecting device used in bending an embossed metallic straight pipe with a small diameter and a thin wall and having an artistic embossed pattern thereon. The device is comprised of a plastic die core for put in the straight pipe; a pair of half-dies are put on and envelop the straight pipe. A plastic pipe is slipped over the half-dies, then a spiral spring is slipped over the plastic pipe, and further a tension spring is slipped over the spiral spring. Both open ends of the tension spring are provided with a sealing cover. The die-protecting device formed is used for bending the embossed metallic straight pipe with a small diameter and a thin wall and having an artistic embossed pattern thereon. The device has a function of scattering the bending stress on the pipe wall, and thus has a protection effect preventing the pipe wall from collapsing during bending forming.

2. Description of the Prior Art

In conventional techniques of bending a metallic straight pipe used in the art, the most convenient method is to place the metallic straight pipe on a bending machine to bend and make modeling with mechanic arms. Such method has been widely used in pipe connection operation of steel pipes (such as iron gas pipes, water pipes etc.). However until now, it is not that all the metallic pipes suit bending and modeling on bending machines, their pipe bodies must have enough thickness and stiffness to be processed by bending and modeling without deformation. For example, aluminum or copper pipes made of non-ferrous alloy do not suit bending and modeling on bending machines. This is because the metallic pipes of such material have inferior stiffness than that of steel alloy, and is subjected to overly large stress concentration in the pipes. And more, no matter what material the metallic pipes are made of, if their diameters are too small and their walls are too thin, difficulty in bending operation will be increased relatively. This has not mentioned the metallic pipes with small diameters and thin walls having artistic embossed pattern thereon (they are called embossed metallic pipes in the present invention) which are even larger in difficulty. There has not yet had a technique in the art to use a more easily operated bending machine to proceed bending operation on such pipes, because it is difficult to practice. Thereby, it is a bottleneck hard to overcome in raising bending techniques toward delicate artistic modeling of the pipe articles (metallic pipes). Delicate articles such as metallic rails, table legs, chair legs or show shelves etc. with small diameters and thin walls and having artistic embossed patterns thereon are hard to process by bending when they have been made straight embossed pipes and are desired to be bent.

SUMMARY OF THE INVENTION

Accordingly, it is hard by conventional techniques to bend metallic straight pipes with small diameters and thin walls on a more easily operated bending machine.

Therefore, the object of the present invention is to provide a die-protecting device being adapted to mounting to cover the inner and the external wall surfaces of an embossed metallic straight pipe with a small diameter and a thin wall. Therefore, the die-protecting device can be a support device for the embossed pipe when being bent in the bending machine. The artistic embossed pipe wall thus is effectively supported and the bending force can be scattered and equally distributed.

To get the above stated object, the die-protecting device of the present invention is provided with the following technical characteristic:

1. A plastic die core is provided in the pipe hole by placing a plastic bag in the hole, loading therein with mercury and then sealing the mouth of the bag. The mercury with a high specific gravity squeezes the plastic bag to render the plastic die core adequately full filled in the grains of the inner wall of the pipe to help the wall to bear bending force to get desired bending curvatures. And the bending force borne by the whole wall can be scattered and almost equally distributed.
2. A pair of plastic half-dies are put on and envelop the external wall surface of the embossed pipe. The plastic half-dies are made of polyurethane or rubber to be provided with die cavities having the contour of the external wall surface of the embossed pipe. The external walls of the plastic half-dies present a cylinder shape; in this way, the embossed pipe can be tightly contacted therewith to protect grains of the external wall of the embossed pipe in squeezing. And the plastic half-dies can also be made by melting polyurethane or rubber uniformly blended with iron sand in molds in pursuance of the strength of the straight embossed pipe, this can further increase supporting function for an embossed pipe.
3. A flexible plastic pipe made of PET or PVC plastic material is slipped over the half-dies, thus effectively protects the half-dies from bending force and keeps stability of the closed state of the half-dies during bending.
4. A spiral spring is slipped over the plastic pipe to scatter with its larger contact area the action force transmitted to the plastic pipe, so that the half-dies and the various areas of the plastic pipe being bent can bear more equalized bending force.
5. A tension spring is slipped over the spiral spring. So that the bending force exerted on the spiral spring, the half-dies, the embossed pipe and the plastic pipe can be more uniform.
6. Both open ends of the tension spring are provided with a sealing cover. Each sealing cover is provided therein with a cavity which is loaded therein with an exposed elastic valve head bearing a spring and elastically supporting either end of the die core 3 in the pipe hole of the embossed pipe. Therefore, the elastic valve heads are used as safety devices capable of absorbing the expansion by squeezing during bending forming of the die core under the bending force from the pipe wall. And further are capable of providing space for mercury to release pressure with the cavity when the pipe wall is overly exerted with action force.

The present invention will be apparent after reading the detailed description of its preferred embodiments in reference to the accompanying drawings.

DETAILED DESCRIPTION OF THE PREFERRED EMBODIMENT

Figure 1:
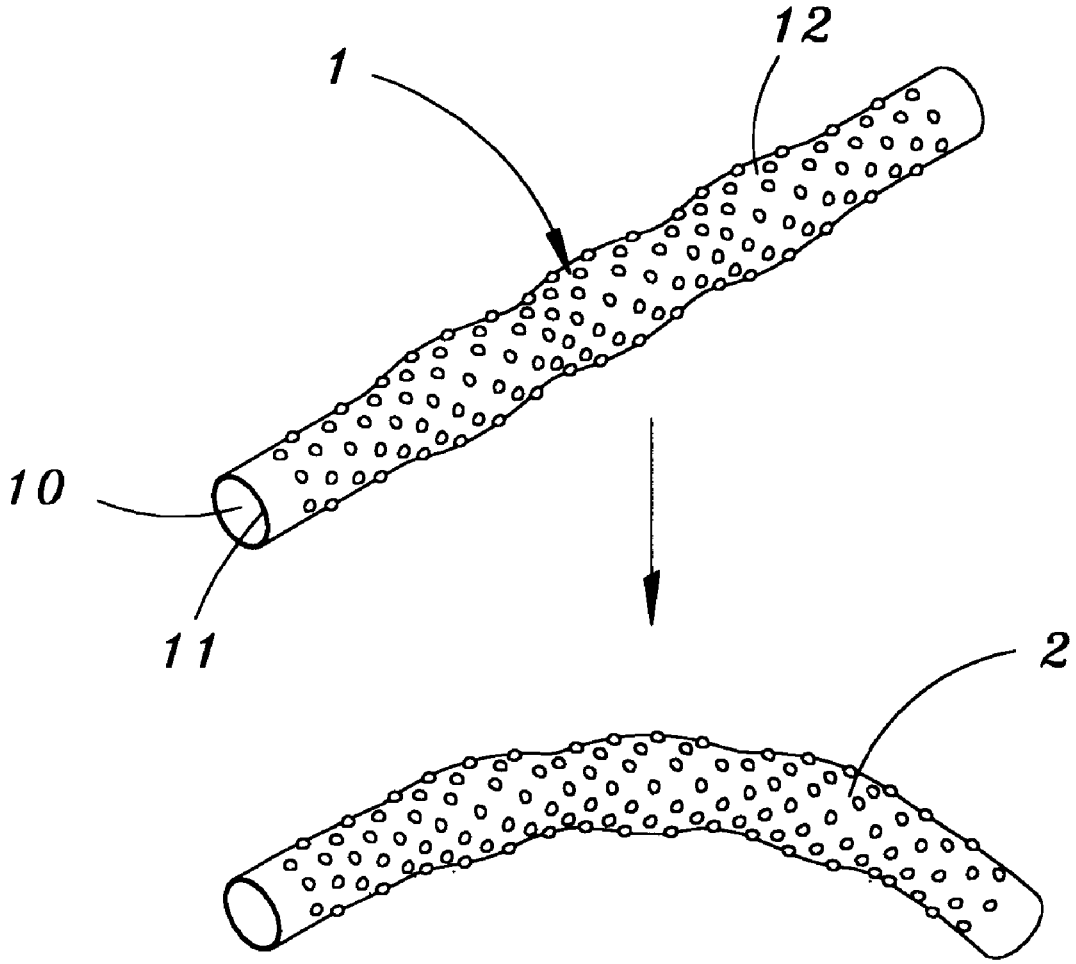
FIG. 1 is a perspective view showing the straight embossed pipe is to be bent to form a bent embossed pipe in the present invention.

Referring to FIG. 1, the die-protecting device of the present invention is used to successfully bend a straight embossed pipe 1 with a small diameter and a thin wall into a bent embossed pipe 2 having desired curvature. Bending forming of a straight embossed pipe 1 with artistic embossed pattern thereon directly in a bending machine without any die-protecting device will result collapsing and deformation of the pipe wall. Therefore, using of the die-protecting device of he present invention in bending forming of a bent embossed pipe 2 is extremely important and indispensable.

Figure 2:
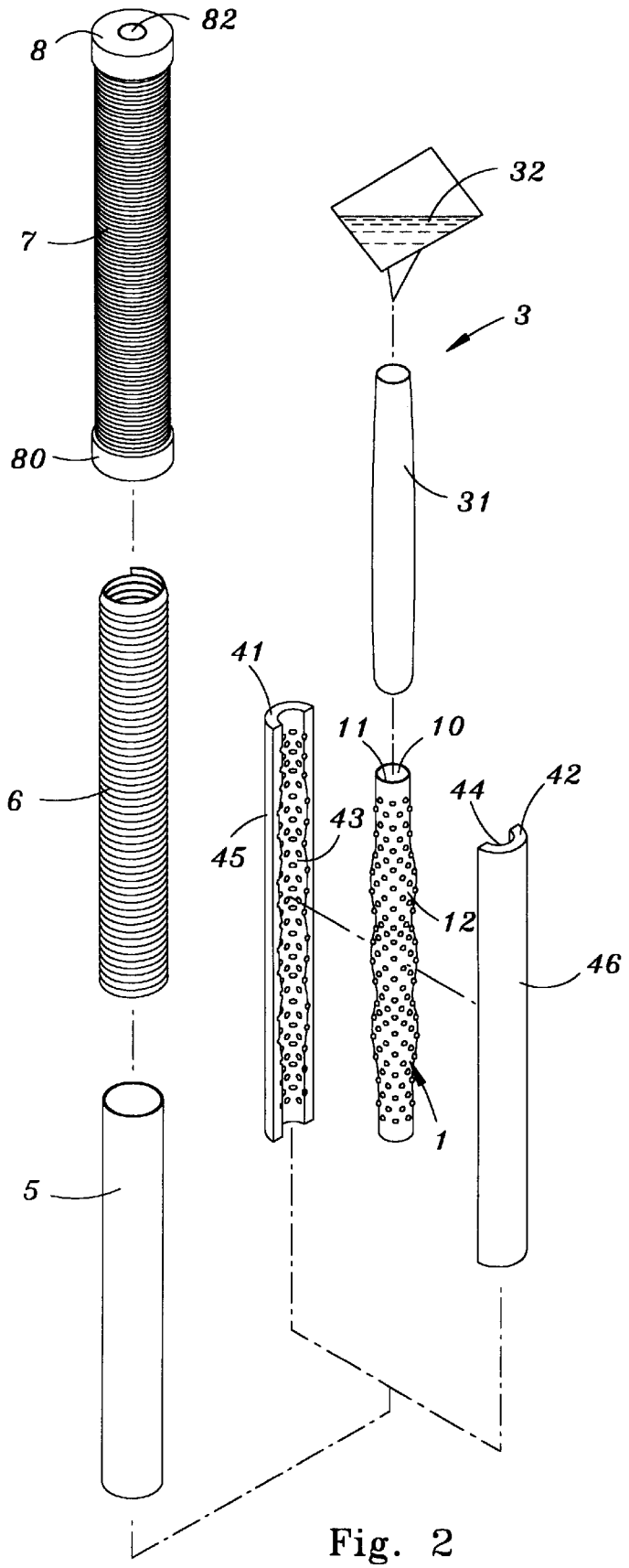
FIG. 2 is a perspective view showing mounting of the die-protecting device of the present invention.

The die-protecting device of the present invention is comprised of a plastic die core 3, a pair of half-dies 41, 42, a plastic pipe 5, a spiral spring 6, a tension spring 7 and two sealing covers 8 and 80 (as shown in FIG. 2).

Figure 3:
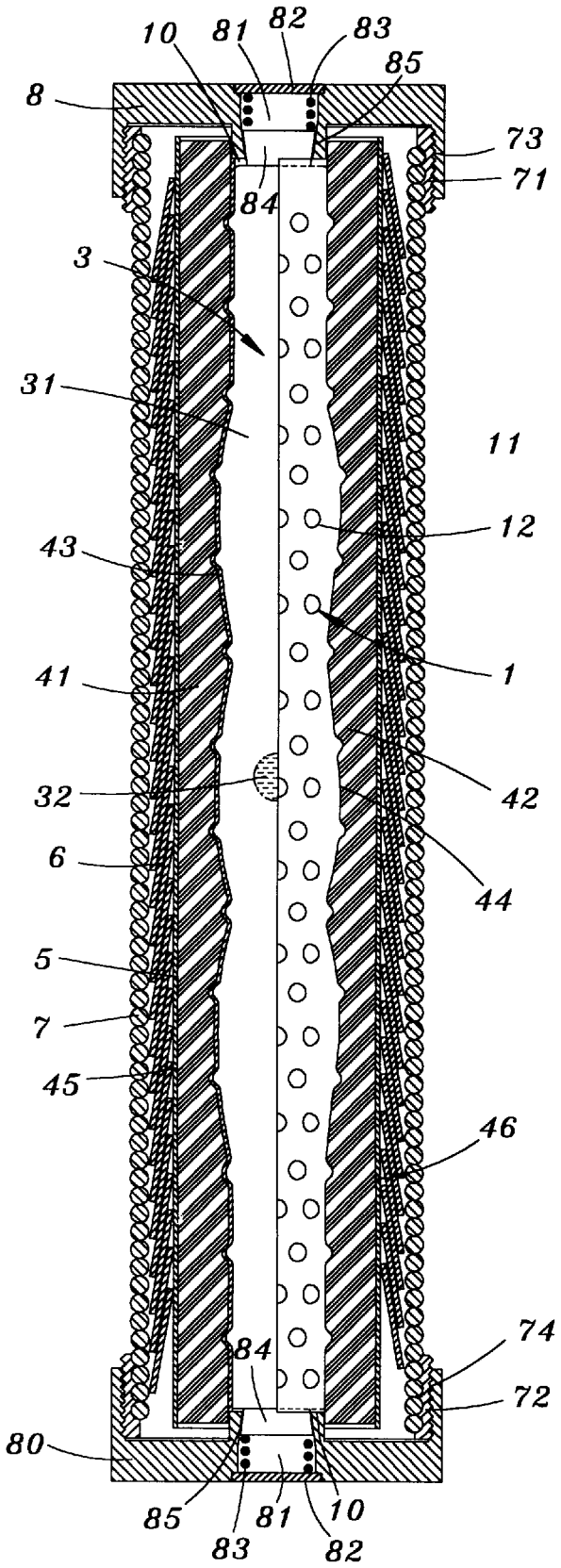
FIG. 3 is a sectional view of the die-protecting device of the present invention.

Wherein, he die core 3 is plastic, and is made by placing a plastic bag 31 in a hole 10 of the embossed pipe 1, loading therein with mercury 32 and then sealing the mouth of the bag 31 (as shown in FIG. 2). The mercury 32 with a high specific gravity in the hole 10 squeezes the plastic bag 32 to render the plastic die core 3 adequately full filled in the grains of the inner wall 11 of the pipe hole 10 (as shown in FIG. 3). This helps the wall 11 to bear bending force to get the desired bending curvature. And the bending force can be scattered and almost equally distributed (also referring to FIG. 5) to the whole wall 11.

Figure 5:
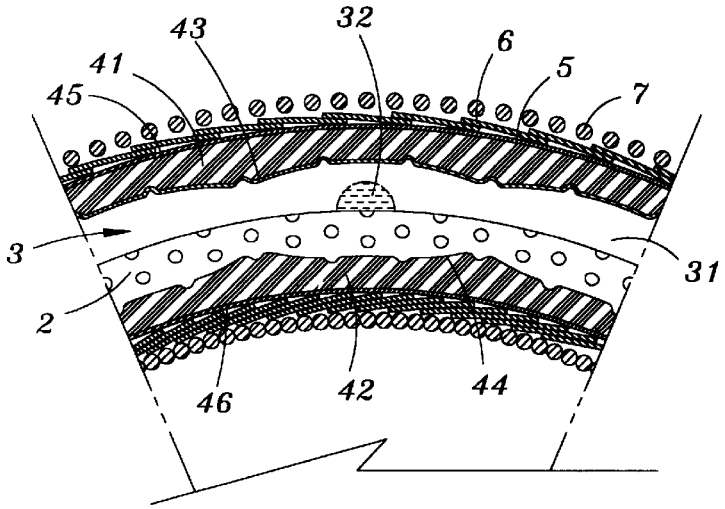
FIG. 5 is a sectional view showing the state after bending forming of the embossed pipe enveloped with the die-protecting device of the present invention.

The pair of half-dies 41, 42 are made by mould forming of polyurethane or rubber. And the half-dies 41, 42 are provided with die cavities 43, 44 having the contour of the external wall surface 12 of the embossed pipe 1 and having external walls 45, 46 in half-cylinder shapes (as shown in FIG. 2). In this way, the external wall surface 12 of the embossed pipe 1 can tightly contact with the die cavities 43, 44 (as shown in FIG. 3) to protect grains of the external wall 12 of the embossed pipe 1 in squeezing during bending forming (as shown in FIG. 5). And the plastic half-dies 41, 42 can also be made by melting polyurethane or rubber uniformly blended with iron sand in molds in pursuance of the strength of the straight embossed pipe 1, this can further increase supporting function for the embossed pipe 1.

The plastic pipe 5 which is flexible and made of PET or PVC plastic material is slipped over the half-dies 41, 42 (as shown in FIG. 2 and 3). Thus it effectively protects the half-dies 41, 42 bearing bending force and keeps stability of the closed state of the half-dies 41, 42 during bending (as shown in FIG. 5).

The spiral spring 6 is slipped over the plastic pipe 5 (as shown in FIG. 2) to scatter with its larger contact area the action force transmitted to the plastic pipe 5. So that the half-dies 41, 42 and the various areas of the plastic pipe 5 being bent can bear more equalized bending force (also referring to FIG. 5).

The tension spring 7 is slipped over the spiral spring 6 (as shown in FIG. 2 and 3). so that the bending force exerted on the spiral spring 6, the half-dies 41, 42, the embossed pipe 1 and the plastic pipe 5 can be scattered and more uniformly distributed (also referring to FIG. 5). The two open ends of he tension spring 7 have annuli 71, 72 provided with external threads 73, 74 and welded thereto (as shown in FIG. 3) for mounting sealing covers 8, 80. Each sealing cover 8 (80) is provided therein with a cavity 81 covered with a lid 82 as shown in FIG. 3. The cavity 81 is loaded therein with an exposed elastic valve head 84 bearing a spring 83 and elastically supporting either end of the die core 3 in the pipe hole 10 of the embossed pipe 1. Therefore, the elastic valve heads 84 are used as safety devices capable of absorbing the expansion by squeezing during bending forming of the die core 3 under the bending force from the pipe wall 11. And a valve hole 85 is provided between the cavity 81 and the elastic valve head 84 too provide space for the mercury 32 to move in the cavity 81 to release pressure when the pipe wall 11 is overly exerted with action force. Thereby, the mercury 32 can be prevented from out flowing and can be appropriately pressure released.

Figure 4:
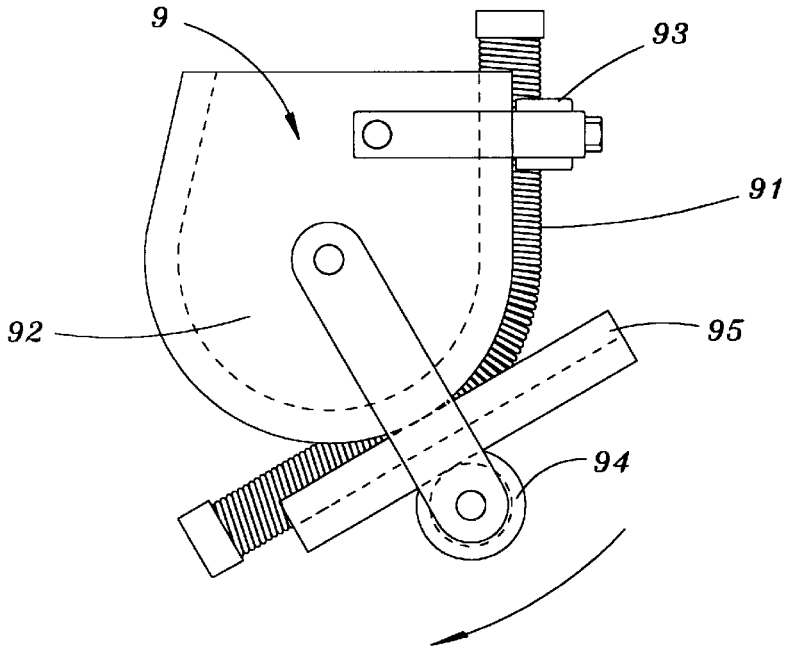
FIG. 4 is a sectional view showing bending forming of the embossed pipe enveloped with the die-protecting device of the present invention in a bending machine.

As shown in FIG. 4, bending process of a bending machine 9 with an embossed pipe 91 enveloped by the die-protecting device of the present invention is depicted here. Wherein, the embossed pipe 91 with the die-protecting device thereon is placed on a bending seat 92. A clamp plate 93 and a swiveling arm with a wheel 94 and a bending strip 95 thereon are used to proceed bending forming on the embossed pipe 91 by swiveling of the swiveling arm. In this way, the original straight embossed pipe 1 can be bent to form a bent embossed pipe 2.

In conclusion, it is not difficult to find that the present invention is a highly useful device for production, especially for bending the embossed metallic straight pipe with a small diameter and a thin wall and having an artistic embossed pattern thereon. By using the die-protecting device of the present invention, the bending processes originally not able to practice can be completed, and those artistic embossed pipes requiring higher strength after bending can be easily obtained.

Having thus described my invention, what I claim as new and desire to be secured by Letters Patent of the United States are:

1. A die-protecting device used in bending an embossed metallic straight pipe with a small diameter and a thin wall into a bent embossed pipe on a bending machine, being comprised of a die core, a pair of half-dies, a flexible plastic pipe, a spiral spring, a tension spring and two sealing covers, said die core is made by placing a plastic bag in a hole of said embossed pipe, loading therein with mercury and then sealing the mouth of said plastic bag, said device is characterized by:

said pair of half-dies are made by mould forming with polyurethane or rubber and are provided with die cavities having the contour of the external wall surface of said embossed pipe;

said straight embossed pipe is placed in said pair of half-dies, said flexible plastic pipe is slipped over said half-dies, then said spiral spring is slipped over said plastic pipe, and further said tension spring is slipped over said spiral spring, the two open ends of said tension spring have annuli provided with external threads and welded thereto for mounting said sealing covers, thereby said die-protecting device is adapted for supporting and bending said embossed metallic straight pipe on said bending machine.

2. A die-protecting device used in bending an embossed metallic straight pipe with a small diameter and a thin wall as claimed in claim 1, wherein, said sealing covers are provided both with a cavity and a lid covering said cavity, each of said cavities is loaded therein with an exposed elastic valve head bearing a spring and elastically supporting either end of said die core in said hole of said embossed pipe, said device therefore is used as a safety device adapted for absorbing the expansion by squeezing during bending forming of said die core under the bending force from said wall of said embossed pipe.

3. A die-protecting device used in bending an embossed metallic straight pipe with a small diameter and a thin wall as claimed in claim 2, wherein, a valve hole is provided between said cavity and said elastic valve head to provide space for said mercury to move in said cavity to release pressure when said wall of said embossed pipe is overly exerted with action force.

* * * * *